US008065981B2

(12) United States Patent
Ishida

(10) Patent No.: US 8,065,981 B2
(45) Date of Patent: Nov. 29, 2011

(54) STRATIFIED SCAVENGING TWO-CYCLE ENGINE

(75) Inventor: Shigetoshi Ishida, Chiba (JP)

(73) Assignee: Nikko Tanaka Engineering Co., Ltd., Tokyo (JP)

( * ) Notice: Subject to any disclaimer, the term of this patent is extended or adjusted under 35 U.S.C. 154(b) by 0 days.

(21) Appl. No.: 12/309,054

(22) PCT Filed: Jun. 21, 2007

(86) PCT No.: PCT/JP2007/062520

§ 371 (c)(1),
(2), (4) Date: Aug. 24, 2009

(87) PCT Pub. No.: WO2008/004449

PCT Pub. Date: Jan. 10, 2008

(65) Prior Publication Data

US 2010/0059030 A1 Mar. 11, 2010

(30) Foreign Application Priority Data

Jul. 5, 2006 (JP) ..... 2006-185520

(51) Int. Cl.
*F02B 25/00* (2006.01)

(52) U.S. Cl. ..... 123/73 AA; 123/73 A; 123/73 PP

(58) Field of Classification Search ..... 123/73 C, 123/73 PP, 65 W, 65 WA, 193.4, 73 A, 193.6; 277/370, 454; 60/285; *F02B 25/00*
See application file for complete search history.

(56) References Cited

U.S. PATENT DOCUMENTS

| | | | | |
|---|---|---|---|---|
| 4,711,201 | A * | 12/1987 | Ooyama et al. | 123/73 A |
| 6,135,072 | A | 10/2000 | Kishita | |
| 6,289,856 | B1 * | 9/2001 | Noguchi | 123/73 PP |
| 7,536,982 | B2 | 5/2009 | Yuasa et al. | |
| 2002/0043227 | A1 | 4/2002 | Carlsson et al. | |

FOREIGN PATENT DOCUMENTS

| | | | |
|---|---|---|---|
| EP | 0 992 660 | A1 | 4/2000 |

(Continued)

OTHER PUBLICATIONS

Extended European Search Report (EESR) dated Jun. 14, 2011 (in English) in counterpart European Application No. 07767346.5.

*Primary Examiner* — Michael Cuff
*Assistant Examiner* — Keith Coleman
(74) *Attorney, Agent, or Firm* — Holtz, Holtz, Goodman & Chick, P.C.

(57) ABSTRACT

A stratified scavenging two-cycle engine that has a simpler structure than conventional stratified scavenging two-cycle engines and that has an excellent blow-by prevention effect etc. In an air intake stroke, lead air passes a lead-air port (12) etc. to flow into an inner space of a piston (6) during a period from the instant at which a lateral groove (21*b*) starts to superpose on the lead-air port (12) until the superposing between the lateral groove (21*b*) and the lead-air port (12) disappears after the piston (6) passes its top dead center. Further, in a scavenging stroke, lead air passes a scavenging path (17) etc. to flow into a cylinder (4) from a scavenging port (18) during a period from the instant at which a scavenging connection opening (20) and a scavenging inflow opening (19) start to superpose on each other until the superposing between the scavenging connection opening (20) and the scavenging inflow opening (19) disappears after the piston (6) passes its bottom dead center. Then, a mixture gas passes the inside of the piston (6) to flow into the cylinder (4) from the scavenging port (18).

6 Claims, 5 Drawing Sheets

FOREIGN PATENT DOCUMENTS

| | | | |
|---|---|---|---|
| EP | 1 498 588 | A2 | 1/2005 |
| EP | 1 550 799 | A1 | 7/2005 |
| JP | 7-189704 | A | 7/1995 |
| JP | 10-121973 | A | 5/1998 |
| JP | 11-210473 | A | 8/1999 |
| WO | WO 98/57053 | A1 | 12/1998 |

* cited by examiner

FIG. 4
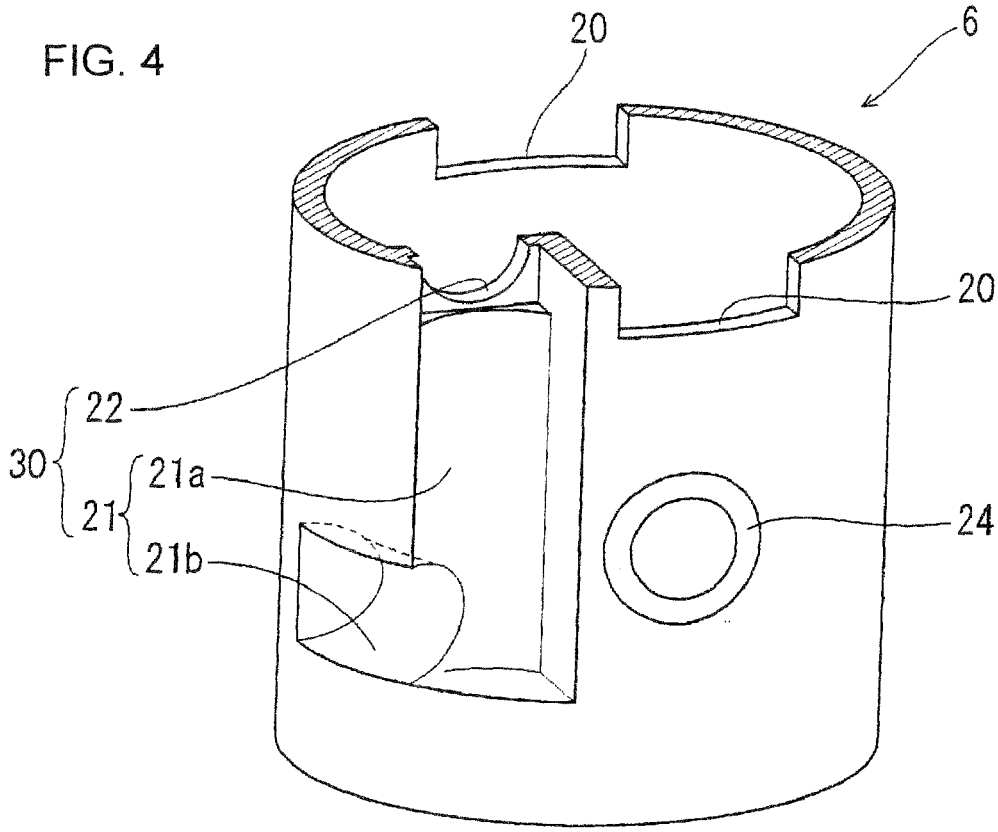
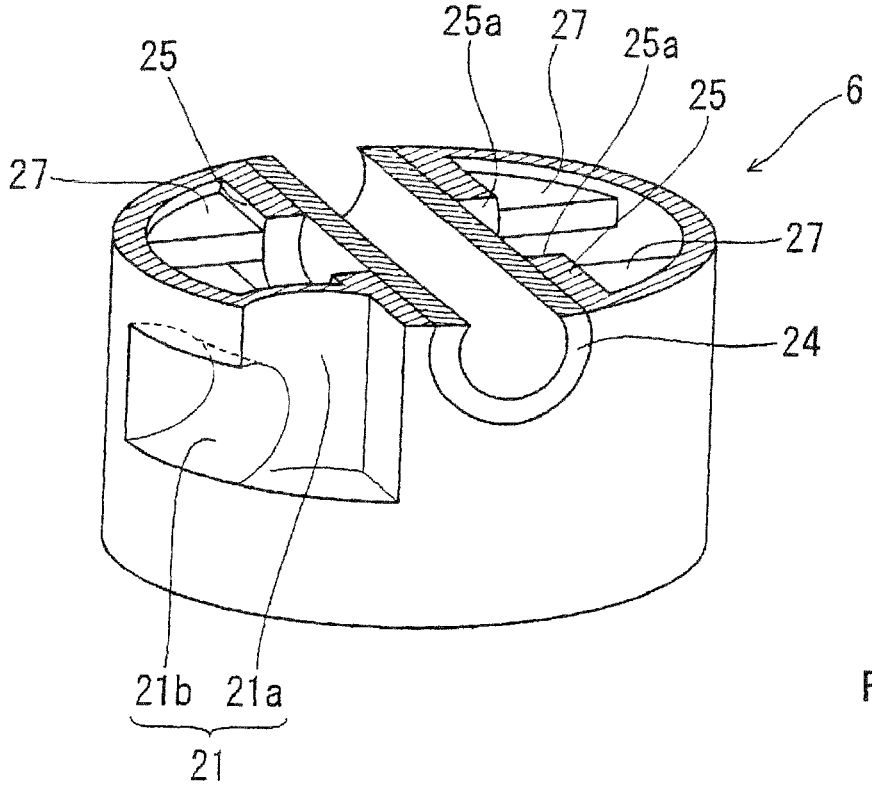
FIG. 5

STRATIFIED SCAVENGING TWO-CYCLE ENGINE

This application is a U.S. National Phase Application under 35 USC 371 of International Application PCT/JP2007/062520 filed Jun. 21, 2007.

TECHNICAL FIELD

The present invention relates to a two-cycle engine, and more particularly to a stratified scavenging two-cycle engine configured so that air (lead air) introduced in advance flows from a scavenging port into a cylinder during a scavenging stroke and then an air-fuel mixture is supplied from a crank chamber via a scavenging passage and from the scavenging port into the cylinder.

BACKGROUND

An engine (stratified scavenging two-cycle engine) is known in which lead air that has been introduced in advance into a scavenging passage or the like and then an air-fuel mixture flow in a stratified manner from a scavenging port into a cylinder during a scavenging stroke, whereby the non-combusted gas can be prevented from flowing out from an exhaust port (blow-by can be prevented).

A variety of systems for introducing the lead air into the scavenging passage or the like are employed in stratified scavenging two-cycle engines. With the most basic configuration, an external air introduction path having a reed valve is connected to the scavenging passage, and the external air (lead air) flows in from the external air introduction path into the scavenging passage due to the pressure reduction in the crank chamber in the compression stroke.

Patent Document 1: Japanese Patent Application Laid-open No. 10-121973.

DISCLOSURE OF THE INVENTION

Problems to be Resolved by the Invention

The problems associated with the conventional stratified scavenging two-cycle engine are that a complex structure is used to prevent the non-combusted gas from flowing out from the scavenging port (to prevent the blow-by), the number of parts is larger than in the typical two-cycle engine, and the production cost is high.

The present invention has been created to resolve these problems inherent to the conventional technology, and it is an object of the present invention to provide a stratified scavenging two-cycle engine of a simple structure in which an excellent effect in terms of blow-by prevention and the like can be expected.

Means of Solving the Problems

In the stratified scavenging two-cycle engine in accordance with the present invention, a lead air flow channel for causing lead air to flow from the outside into an inner space is formed in a piston; a scavenging communication port is formed in a side portion of the piston; an exhaust port, a lead air port, a scavenging port, and a scavenging inflow port are formed in an inner circumferential surface of a cylinder; the scavenging port and the scavenging inflow port are air-tightly connected by a scavenging passage; the scavenging communication port is formed in a position such that the scavenging communication port overlaps the scavenging inflow port when the piston is located close to a bottom dead center; the lead air flow channel is formed in a position such that an end portion at one side of the lead air flow channel overlaps the lead air port of the cylinder when the piston is located close to a top dead center; in an intake process, while the end portion at one side of the lead air flow channel overlaps the lead air port, the lead air flows into the inner space of the piston via the lead air port and the lead air flow channel; and in a scavenging process, while the scavenging communication port and the scavenging inflow port overlap, the lead air flows from the scavenging port into the cylinder via the scavenging communication port, the scavenging inflow port, and the scavenging passage and then an air-fuel mixture located in a crank chamber flows from the scavenging port into the cylinder via the inside of the piston, the scavenging communication port, the scavenging inflow port, and the scavenging passage.

Preferably, the lead air flow channel is configured by a groove formed in an outer circumferential surface of the piston and a lead air inflow port communicating with the inner space of the piston; the groove is formed in an L-like shape composed of a vertical groove and a transverse groove extending transversely from the lower end of the vertical groove; the lead air inflow port is formed at the upper end of the vertical groove; and an end portion of the transverse groove is formed in a position such that the end portion overlaps the lead air port when the piston is located close to the top dead center. It is also preferred that a rib for inhibiting an air flow in the up-down direction be formed inside the piston. It is further preferred that the lead air inflow port be configured so as to be open in the tangential direction of the inner circumferential surface of the piston.

ADVANTAGEOUS EFFECTS OF THE INVENTION

With the stratified scavenging two-cycle engine in accordance with the present invention, the lead air that is first to flow and the air-fuel mixture that follows the lead air can be caused to flow sequentially into the cylinder and the outflow (blow-by) of the non-combusted gas from the exhaust port can be effectively reduced. As a result, the non-combusted gas HC in the exhaust gas can be decreased and an engine with a low fuel consumption ratio and good combustion efficiency can be realized.

Further, the engine can be configured without using complex elements such as a reed valve, and the scavenging passage can be very short and can have a compact and simple structure. Furthermore, because the lead air and the air-fuel mixture introduced from the outside pass inside the piston, the piston can be effectively cooled. In addition, because the scavenging passage can be reduced in length in comparison with the conventional configuration, the air-fuel mixture can be combusted with a very high efficiency even in a high-speed revolution range, and a high-output engine can be obtained.

Further, when a rib is formed inside the piston, circulation of air in the up-down direction inside the piston can be advantageously inhibited. In addition, when the lead air inflow port is configured so as to be open in the tangential direction of the inner circumferential surface of the piston, the lead air introduced inside the piston in the intake stroke can be caused to rotate along the inner circumferential surface of the piston. As a result, the lead air introduced inside the piston and the air-fuel mixture located in the crank chamber can be advantageously separated until a transition can be made to the scavenging process.

BEST MODE FOR CARRYING OUT THE INVENTION

The best mode for carrying out the present invention will be described below with reference to the appended drawings. FIG. 1 is a cross-sectional view of a stratified scavenging two-cycle engine 1 (cross-sectional view of a cylinder block 2 and crank case 3) of the first embodiment of the present invention. In the figure, the reference numeral 4 stands for a cylinder, 5—a crank chamber, 6—a piston (state in which the piston is in the top dead center), and 26—a connecting rod.

A carburetor 8 is connected via an insulator 7 to one side of the cylinder block 2, and an air feed passage 9 and a lead air passage 10 are formed inside thereof. The air feed passage 9 and lead air passage 10 communicate respectively with the cylinder 4 via an intake port 11 and a lead air port 12 opened at the inner circumferential surface of the cylinder 4. Further, an exhaust passage 13 is formed at the opposite side of the cylinder block 2. The exhaust passage 13 communicates with the cylinder 4 via an exhaust port 14 opened at the inner circumferential surface of the cylinder 4. In the figure, the reference numeral 15 stands for a throttle valve and 16—an air valve.

FIG. 2 is an end surface view of the insulator 7 along the X-X line shown in FIG. 1. For the sake of convenience of explanation, the intake port 11 and the lead air port 12 are shown side by side in the up-down direction in FIG. 1, but actually they are displaced with respect to each other in the left-right direction, as shown in FIG. 2.

FIG. 3 is a cross-sectional view of the cylinder block 2 and piston 6 along the Y-Y line shown in FIG. 1. This figure shows the state in which the piston 6 is in the bottom dead center. As shown in this figure, a pair of scavenging passages 17 are formed in opposing positions sandwiching the axial line of the cylinder 4 inside the cylinder block 2. The scavenging passages 17 extend in the up-down direction, communicate with scavenging ports 18 and scavenging inflow ports 19 opened side by side in the up-down direction with a predetermined spacing therebetween at the inner circumferential surface of the cylinder 4.

The scavenging ports 18 are formed in positions such that the upper edge thereof is lower than an upper edge of the exhaust port 14 and such that they are completely open when the piston 6 is in (close to) the bottom dead center. Further, as shown in FIG. 3, the bottom side of the piston 6 is widely opened (lower opening 6*a*), and the inner space of the piston 6 communicates with the crank chamber 5 (see FIG. 1) via the lower opening 6*a* at all times.

FIG. 4 is a cross-sectional perspective view of the piston 6 along the Z1 line shown in FIG. 1. As shown in FIG. 4 (and FIG. 1, FIG. 3), a pair of through holes (scavenging communication ports 20) are formed in opposing positions sandwiching the axial line of the piston 6 at the upper end of the side surface of the piston 6. Further, a lead air flow channel 30 is formed in the piston 6. In the present embodiment, the lead air flow channel 30 is configured by an L-shaped groove 21 and a lead air inflow port 22. The groove 21 includes a vertical groove 21*a* formed in the outer circumferential surface of the piston 6 and a transverse groove 21*b* extending in the transverse direction from the lower end of the vertical groove. The lead air inflow port 22 is configured so as to be open in the tangential direction of the inner circumferential surface of the piston 6 at the upper end of the vertical groove 21*a*. Further, an inner space of the groove 21 (a space bounded by the groove 21 and the inner circumferential surface of the cylinder 4) communicates with the inner space of the piston 6 via the lead air inflow port 22 at all times.

As shown in FIG. 3, the scavenging communication ports 20 are formed in positions such that the scavenging communication ports 20 overlap the scavenging inflow ports 19 (starting points of scavenging passages 17) that are formed in the inner circumferential surface of the cylinder 4 when the piston 6 is in (close to) the bottom dead center. Therefore, when the piston 6 is in (close to) the bottom dead center, the inner space of the piston 6 communicates with the scavenging passages 17 via the scavenging communication ports 20 and the scavenging inflow ports 19, but when the scavenging communication ports 20 do not overlap the scavenging inflow ports 19 (or the scavenging ports 18), the scavenging communication ports 20 are closed by the inner circumferential surface of the cylinder 4.

As shown in FIG. 1, the transverse groove 21*b* of the groove 21 is formed in a position such that it overlaps the lead air port 12 formed in the inner circumferential surface of the cylinder 4 when the piston 6 is in (close to) the top dead center. Therefore, when the piston 6 is in (close to) the top dead center, the inner space of the groove 21 communicates with the lead air passage 10 via the lead air port 12, but when the transverse groove 21*b* does not overlap the lead air port 12, the groove 21 is closed in relation with the outer side of the cylinder 4.

As shown in FIG. 2, the intake port 11 is located in a position shifted to the left with respect to the lead air port 12, and the transverse groove 21*b* of the piston 6 does not overlap the intake port 11 in the up-down cycle of the piston 6.

FIG. 5 is a cross-sectional perspective view of the piston 6 along the Z2 line shown in FIG. 1. FIG. 6 is a plan view of the cross-section of piston 6 shown in FIG. 5. In these figures, the reference numeral 24 stands for a piston pin. As shown in the figures, both ends of the piston pin 24 are held within the cylindrical piston pin bosses 25 formed so as to protrude from the inner circumferential surface of the piston 6 toward the center thereof. End surfaces 25*a* of the two piston bosses 25 sandwich the axial line of the piston 6 and face each other via a predetermined spacing (about ⅓ the diameter of the piston 6). The upper portion of a connecting rod 26 (see FIG. 1 and FIG. 6) into which the piston pin 24 is inserted is held between two opposing end surfaces 25*a* of the piston pin bosses 25.

Further, as shown in FIG. 5 and FIG. 6, in the present embodiment, ribs 27 are formed in both sides of the piston pins bosses 25 (one rib per one side; a total of four ribs). These ribs 27 have a configuration such as to close in the horizontal direction the fan-shaped space between the outer circumferential surface of the piston pin bosses 25 and the inner circumferential surface of the piston 6 and inhibit the flow of air in the up-down direction inside the piston 6.

The operation of the stratified scavenging two-cycle engine 1 of the present embodiments will be explained below. When the piston 6 moves from the bottom dead center toward the upper dead center, the pressure inside the crank chamber 5 decreases. As the piston 6 further rises, within an interval after the intake port 11 starts opening and before it is closed, the air-fuel mixture (new air) flows from the carburetor 8 into the crank chamber 5 via the air feed passage 9 and the intake port 11 under the effect of pressure difference between the inside and the outside of the crank chamber 5.

In this case, because the inner space of the piston 6 communicates with the crank chamber 5 via the lower opening 6*a*, the pressure in this space decreases in the same manner as inside the crank chamber 5. Further, as long as the transverse groove 21*b* formed in the outer circumferential surface of the piston 6 overlaps the lead air port 12 (that is, within the interval from the start of overlapping till the overlapping is canceled and the lead air port 12 becomes closed after the piston 6 has reached the top dead center), because the space within the groove 21 (the space that communicates at all times with the inner space of the piston 6 via the lead air inflow port 22) and the lead air passage 10 communicate with each other via the lead air port 12, the external air (lead air) flows from the lead air passage 10 into the inner space of the piston 6 via the lead air port 12 and lead air flow channel 30 (groove 21, lead air inflow port 22) under the effect of pressure difference between the inside and outside, and the inner space of the piston 6 (in particular, the space above the rib 27 shown in FIG. 5 and FIG. 6) is filled with the lead air. In other words, in the intake stroke of the engine, the lead air and the air-fuel mixture are simultaneously taken in the piston 6 and the crank chamber 5, respectively.

As the piston 6 moves down from the top dead center to the bottom dead center, the pressure inside the crank chamber 5 rises and the pressure inside the inner space of the piston 6 also rises in a similar manner. Then, where the upper edge of the piston 6 becomes lower than the upper edge of the exhaust port 14 and the exhaust port 14 is opened, the combustion gas located in the cylinder 4 starts flowing from the exhaust passage 13 to the outside.

Where the upper edge of the piston 6 then reaches the height matching the upper edge of the scavenging ports 18, the scavenging communication ports 20 of the piston 6 and the scavenging inflow ports 19 of the cylinder 4 start overlapping, and as long as they overlap (that is, within the interval from the start of overlapping till the overlapping is canceled and the scavenging inflow ports 19 become closed after the piston 6 has reached the bottom dead center), the inner space of the piston 6 and the scavenging passages 17 communicate and the scavenging ports 18 are open. Therefore, the lead air filling the inner space of the piston 6 flows from the scavenging ports 18 into the cylinder 4 via the scavenging communication ports 20, the scavenging inflow ports 19, and the scavenging passages 17 under the effect of pressure of the inner space of the piston 6 and the crank chamber 5, pushes out the combustion gas located inside the cylinder 4 from the exhaust port 14, and scavenges the inside of the cylinder 4.

Following the lead air, the air-fuel mixture located inside the crank chamber 5 is pushed out by the raised pressure and flows from the scavenging ports 18 into the cylinder 4 via the inside of the piston 6, the scavenging communication ports 20, the scavenging inflow ports 19, and the scavenging passages 17, and makes a transition to the next process (compression process).

Thus, in the stratified scavenging two-cycle engine 1 of the present embodiment, the lead air and the air-fuel mixture that follows it flow successively into the cylinder 4. As a result, the outflow (blow-by) of the non-combusted gas from the exhaust port 14 can be effectively reduced. As a result, the non-combusted gas HC in the exhaust gas can be decreased and an engine with a low fuel consumption ratio and good combustion efficiency can be realized.

The stratified scavenging two-cycle engine 1 of the present embodiment can be configured without using complex elements such as a reed valve. Furthermore, because the scavenging passages 17 can be very short, can have a compact configuration, and can be formed within a thick portion of the cylinder block 2, the structure can be simplified. In addition, because the number of additional components and structural modifications is very small in comparison with the typical two-cycle engine, the increase in production cost can be minimized and a high-performance engine can be supplied to the market at a low cost.

Furthermore, because the lead air and the air-fuel mixture introduced from the outside pass inside the piston 6, the piston 6 can be effectively cooled. In addition, because the scavenging passages 17 can be reduced in length in comparison with the conventional configuration, the air-fuel mixture can be combusted with a very high efficiency even in a high-speed revolution range, and a high-output engine can be obtained.

Further, as described hereinabove, four ribs 27 are formed inside the piston 6 and the configuration is such that the fan-shaped spaces between the outer circumferential surfaces of the piston pin bosses 25 and the inner circumferential surface of the piston 6 are closed in the horizontal direction (see FIG. 5 and FIG. 6). Therefore, circulation of air in the up-down direction inside the piston 6 can be inhibited by the ribs 27. In addition, because the lead air inflow port 22 formed in the upper end of the vertical groove 21*a* of the piston 6 is open in the tangential direction of the inner circumferential surface of the piston 6, as shown in FIG. 4, the lead air introduced in the piston 6 in the intake stroke can rotate along the inner circumferential surface of the piston 6.

Therefore, it is possible to avoid effectively the occurrence of a situation in which the lead air flows into the space below the ribs 27 and mixes with the air-fuel mixture located in the crank chamber 5 or the air-fuel mixture located in the crank chamber 5 flows into the space above the ribs 27 and decreases the concentration (purity) of the lead air in this space before the space above the ribs 27, of the inner space of the piston 6, is filled with the lead air in the intake process. In other words, the lead air introduced inside the piston 6 and the air-fuel mixture located inside the crank chamber 5 can be advantageously separated before a transition is made to the scavenging process. As a result, the outflow (blow-by) of the non-combusted gas from the exhaust port 14 can be effectively prevented.

In the present embodiment, the lead air flow channel 30 (groove 21 and lead air inflow port 22) for introducing the lead air into the inner space of the piston 6 is formed at a ratio of one lead air flow channel 30 per one piston 6, but two lead air flow channels also may be formed per one piston 6. In this case, the flow rate of the lead air can be increased. Further, in the present embodiment, a system (piston valve system) is employed in which the intake port 11 is open at the inner circumferential surface of the cylinder 4 and this port is opened and closed by the up-down movement of the piston 6. However, this system is not limiting and other intake systems can be employed.

Further, in the present embodiment, the lead air flow channel 30 of the piston 6 is configured by an L-shaped groove 21 and the lead air inflow port 22 disposed at the upper end of the groove 21, as shown in FIG. 4, but this configuration is not necessarily limiting and any configuration may be employed, provided that the lead air can be caused to flow from the outside into the inner space of the piston 6 when the piston 6 is located close to the top dead center. For example, as shown in FIG. 7, a configuration can be employed in which a lead air inflow port 22' is opened at the outer circumferential surface of a piston 6' in a position corresponding to the transverse groove 21*b* shown in FIG. 4 (that is, in the position that overlaps the lead air port 12 formed in the inner circumferential surface of the cylinder 4 when the piston 6' is in (close to) the top dead center), and the lead air inflow port 22' and the inner space (the space above the ribs 27') of the piston 6' are connected by a passage 28 inside the piston.

In this case, in the same manner as in the case in which the piston 6 shown in FIG. 4 is used, while the lead air inflow port 22' opened in the outer circumferential surface of the piston 6' overlaps the lead air port 12 in the intake process, the outer air (lead air) can be caused to flow from the lead air passage 10 into the inner space of the piston 6 via the lead air port 12 and the lead air flow channel 30' (the lead air inflow port 22' and the passage 28 inside the piston), the inner space of the piston 6 (the space above the ribs 27' shown in FIG. 7) can be filled with the lead air, the lead air located within the piston 6' and the air-fuel mixture located in the crank chamber 5 that follows the lead air can be caused to flow sequentially in a stratified manner into the cylinder 4 in the subsequent scavenging process, and the problem of non-combusted gas flowing out from the exhaust port 14 can be effectively avoided.

BRIEF DESCRIPTION OF THE DRAWINGS

FIG. 4 is a cross-sectional perspective view of the piston 6 along the Z1 line shown in FIG. 1.

FIG. 5 is a cross-sectional perspective view of the piston 6 along the Z2 line shown in FIG. 1.

Figure 1:
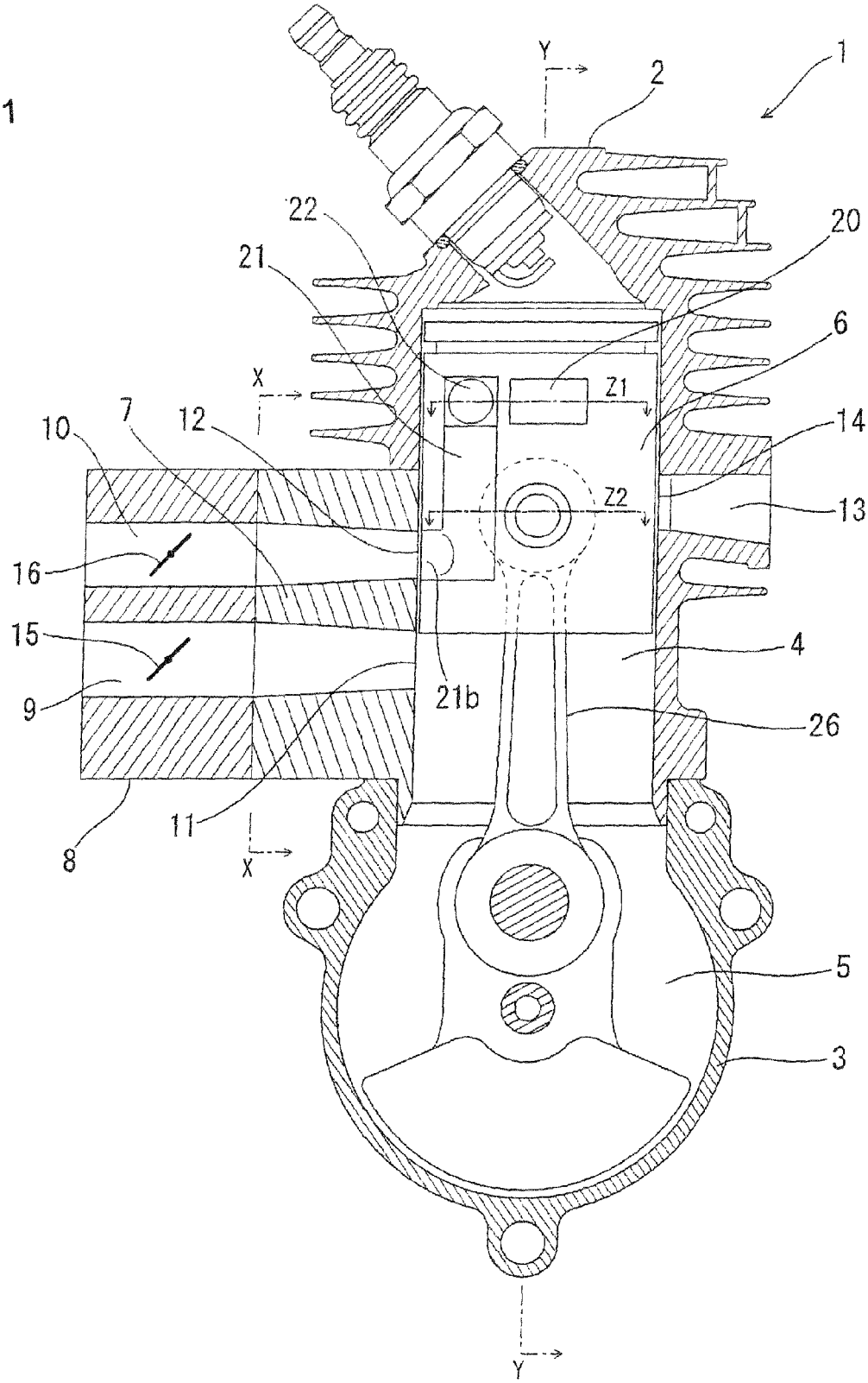
FIG. 1 is a cross-sectional view of the cylinder block 2 and crank case 3 in the stratified scavenging two-cycle engine 1 of the first embodiment of the present invention.
Figure 2:
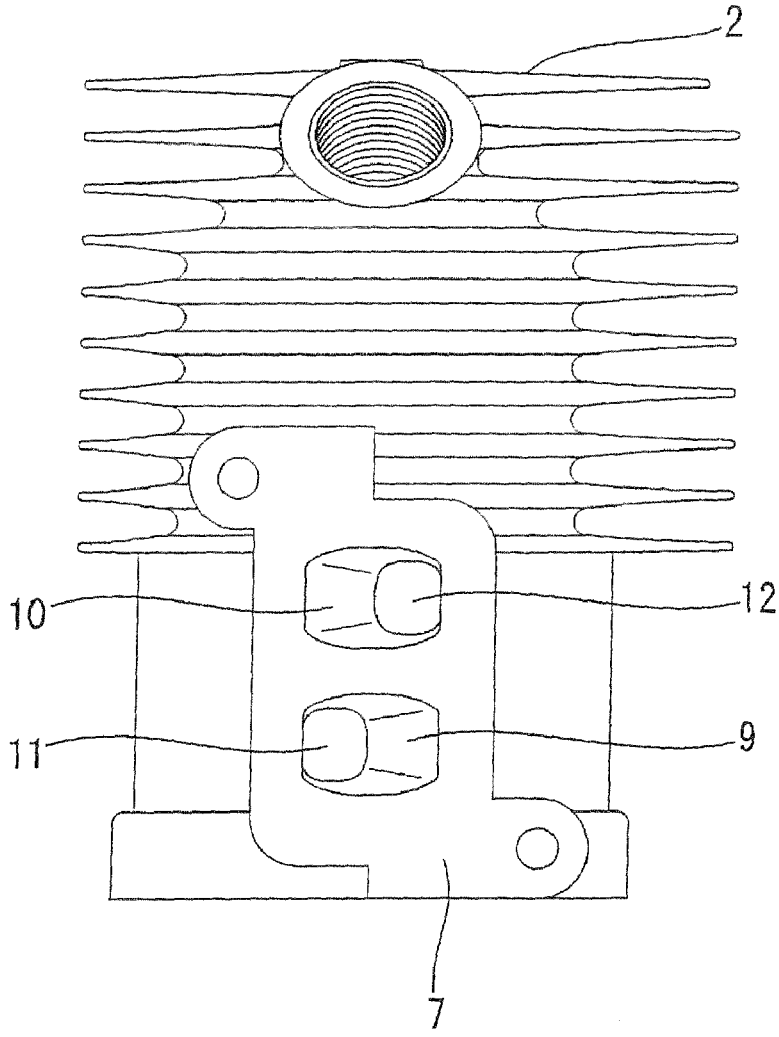
FIG. 2 is an end surface view of the insulator 7 along the X-X line shown in FIG. 1.
Figure 3:
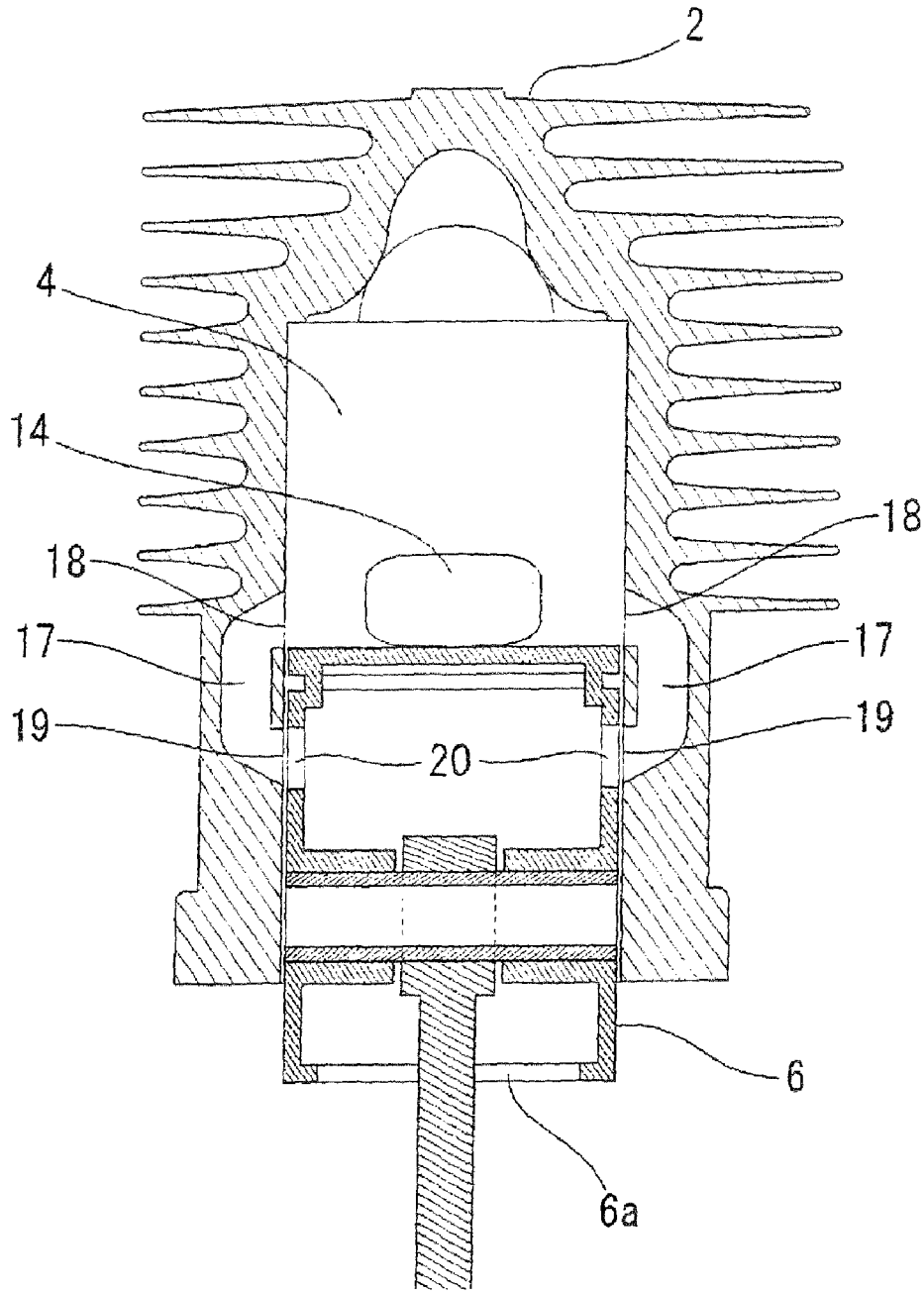
FIG. 3 is a cross-sectional view of the cylinder block 2 and piston 6 along the Y-Y line shown in FIG. 1.
Figure 7:
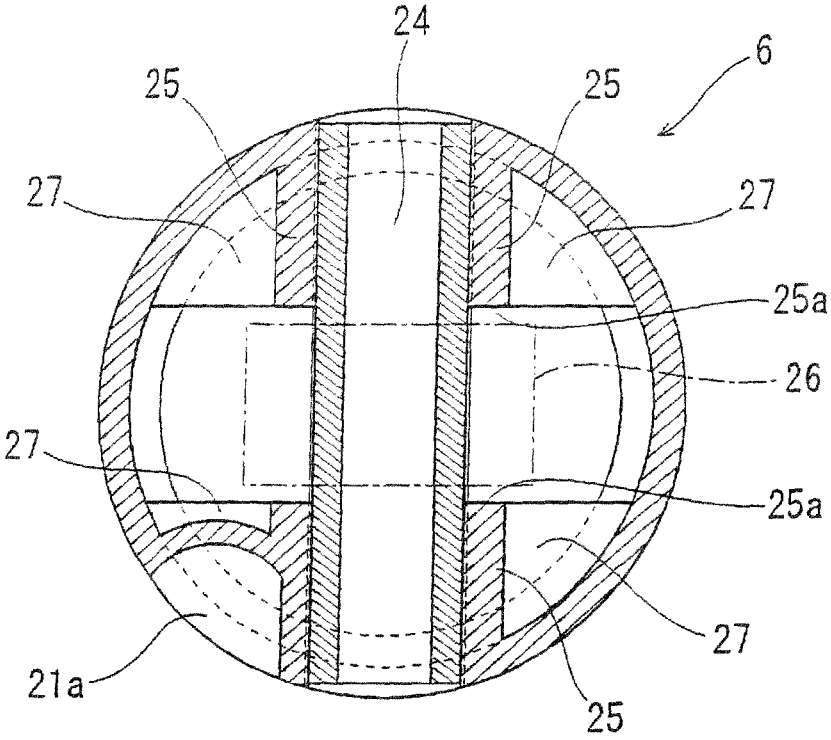
FIG. 7 shows another configuration example of the lead air flow channel 30 in piston 6.
Figure 6:
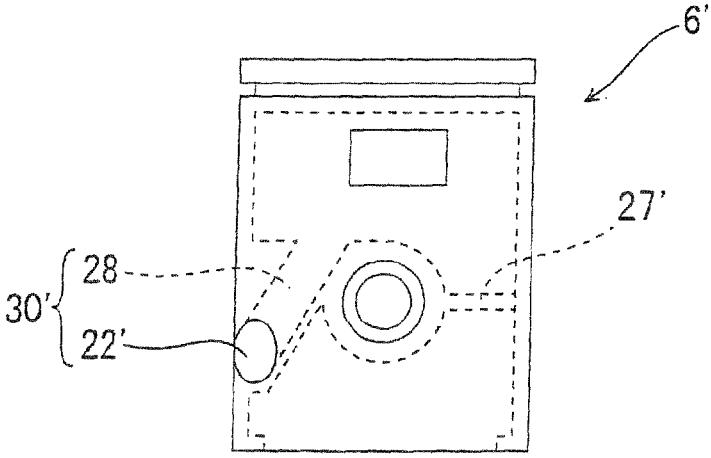
FIG. 6 is a plan view of the cross-section of piston 6 shown in FIG. 5.

1: stratified scavenging two-cycle engine
2: cylinder block
3: crank case
4: cylinder
5: crank chamber
6, 6': piston
6*a*: lower opening
7: insulator
8: carburetor
9: air feed passage
10: lead air passage
11: intake port
12: lead air port
13: exhaust passage
14: exhaust port
15: throttle valve
16: air valve
17: scavenging passage
18: scavenging port
19: scavenging inflow port
20: scavenging communication port
21: groove
21*a*: vertical groove
21*b*: transverse groove
22, 22': lead air inflow port
24: piston pin
25: piston pin boss
25*a*: end surface
26: connecting rod
27, 27': rib
28: passage inside the piston
30, 30': lead air flow channel

The invention claimed is:

1. A stratified scavenging two-cycle engine, comprising:
a piston;
a lead air flow channel provided in the piston for causing lead air to flow from outside into an inner space of the piston, the inner space communicating with a crank chamber;
a scavenging communication port provided in a side portion of the piston; and
an exhaust port, a lead air port, a scavenging port, and a scavenging inflow port provided in an inner circumferential surface of a cylinder;
wherein:
the scavenging port and the scavenging inflow port are air-tightly connected by a scavenging passage;
the scavenging communication port is formed in a position such that the scavenging communication port overlaps the scavenging inflow port when the piston is located close to a bottom dead center;
the lead air flow channel is formed in a position such that an end portion at one side of the lead air flow channel overlaps the lead air port of the cylinder when the piston is located close to a top dead center;
in an intake process, while the end portion at one side of the lead air flow channel overlaps the lead air port, the lead air flows into the inner space of the piston via the lead air port and the lead air flow channel; and
in a scavenging process, while the scavenging communication port and the scavenging inflow port overlap, the lead air located in the inner space of the piston flows from the scavenging port into the cylinder via the scavenging communication port, the scavenging inflow port, and the scavenging passage and then an air-fuel mixture located in the crank chamber flows from the scavenging port into the cylinder via the inside of the piston, the scavenging communication port, the scavenging inflow port, and the scavenging passage.

2. The stratified scavenging two-cycle engine according to claim 1, wherein:
the lead air flow channel comprises a groove formed in an outer circumferential surface of the piston and a lead air inflow port communicating with the inner space of the piston;
the groove is formed in an L-like shape comprising a vertical groove and a transverse groove extending transversely from the lower end of the vertical groove;
the lead air inflow port is formed at an upper end of the vertical groove; and
an end portion of the transverse groove is formed in a position such that the end portion overlaps the lead air port when the piston is located close to the top dead center.

3. The stratified scavenging two-cycle engine according to claim 1, wherein a rib for inhibiting an air flow in an up-down direction is formed inside the piston.

4. The stratified scavenging two-cycle engine according to claim 2, wherein the lead air inflow port is configured so as to be open in a tangential direction of the inner circumferential surface of the piston.

5. The stratified scavenging two-cycle engine according to claim 1, wherein two of the lead air flow channels are provided in the piston.

6. The stratified scavenging two-cycle engine according to claim 2, wherein two of the lead air flow channels are provided in the piston.

* * * * *